US008805244B2

(12) United States Patent
Hoshio

(10) Patent No.: US 8,805,244 B2
(45) Date of Patent: Aug. 12, 2014

(54) CHARGING MEMBER, PROCESS CARTRIDGE, AND IMAGE FORMING APPARATUS

(75) Inventor: Takuro Hoshio, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 664 days.

(21) Appl. No.: 13/028,614

(22) Filed: Feb. 16, 2011

(65) Prior Publication Data

US 2012/0076532 A1 Mar. 29, 2012

(30) Foreign Application Priority Data

Sep. 24, 2010 (JP) ..... 2010-214030

(51) Int. Cl.
*G03G 15/02* (2006.01)

(52) U.S. Cl.
CPC ..... *G03G 15/0233* (2013.01); *Y10S 430/102* (2013.01)
USPC ..... 399/176; 430/902; 492/49; 492/53; 492/56; 492/59; 524/588

(58) Field of Classification Search
USPC ..... 399/176, 174; 492/53
See application file for complete search history.

(56) References Cited

U.S. PATENT DOCUMENTS

| | | | | |
|---|---|---|---|---|
| 5,112,708 | A * | 5/1992 | Okunuki et al. | 430/31 |
| 6,103,815 | A * | 8/2000 | Mammino et al. | 524/546 |
| 6,319,181 | B1 * | 11/2001 | Naoi et al. | 492/56 |
| 6,620,476 | B2 * | 9/2003 | Tarnawskyj et al. | 428/36.8 |
| 2009/0067874 | A1 * | 3/2009 | Hoshio | 399/100 |
| 2010/0104316 | A1 * | 4/2010 | Hoshio et al. | 399/100 |
| 2010/0247149 | A1 * | 9/2010 | Hoshio | 399/176 |
| 2011/0158664 | A1 * | 6/2011 | Hotomi et al. | 399/43 |

FOREIGN PATENT DOCUMENTS

| | | |
|---|---|---|
| JP | A-11-167245 | 6/1999 |
| JP | A-2007-264254 | 10/2007 |
| JP | A-2008-216887 | 9/2008 |

* cited by examiner

*Primary Examiner* — David Gray
*Assistant Examiner* — Geoffrey Evans
(74) *Attorney, Agent, or Firm* — Oliff PLC

(57) ABSTRACT

A charging member includes a substrate and an outermost layer that is on the substrate, is in contact with a member to be charged, and contains a cross-linking fluorocarbon siloxane rubber composition, wherein the charging member charges the member to be charged by being brought into contact with the member to be charged while a voltage is applied.

14 Claims, 3 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under USC 119 from Japanese Patent Application No. 2010-214030 filed Sep. 24, 2010.

BACKGROUND (i) Technical Field

The present invention relates to a charging member, a process cartridge, and an image forming apparatus.

(ii) Related Art

In electrophotographic image forming apparatuses, an electric charge is formed, using a charging device, on the surface of an image carrier, which is a photoconductor containing an inorganic or organic material; an electrostatic latent image is formed using a laser beam or the like modulated in accordance with an image signal; and a visualized toner image is formed by developing the electrostatic latent image with a charged toner. The toner image is electrostatically transferred onto a transfer material such as recording paper through an intermediate transfer body or in a direct manner, and then fixed on a recording material, whereby a desired reproduction image is obtained.

The charging device is a device that charges a member to be charged such as an image carrier and is broadly divided into two types of charging devices, namely, a contact charging device that charges an image carrier through direct contact with the image carrier and a non-contact charging device that charges an image carrier by generating corona discharge near the image carrier without contacting the image carrier. In recent years, contact charging devices that do not produce by-products such as ozone and nitrogen oxide through discharge have been increasingly employed.

Contact charging devices include a charging member that directly contacts the surface of an image carrier and rotates along with the motion of the surface of the image carrier to charge the image carrier.

SUMMARY

According to an aspect of the invention, there is provided a charging member includes a substrate and an outermost layer that is on the substrate, is in contact with a member to be charged, and contains a cross-linking fluorocarbon siloxane rubber composition, wherein the charging member charges the member to be charged by being brought into contact with the member to be charged while a voltage is applied.

BRIEF DESCRIPTION OF THE DRAWINGS

Exemplary embodiments of the present invention will be described in detail based on the following figures, wherein.

DETAILED DESCRIPTION

A charging member, a process cartridge, and an image forming apparatus according to an exemplary embodiment of the invention will now be described.

The charging member of this exemplary embodiment includes a substrate and an outermost layer that is on the substrate, is in contact with a member to be charged, and contains a cross-linking fluorocarbon siloxane rubber composition. The charging member charges the member to be charged by being brought into contact with the member to be charged while a voltage is applied.

The layer structure of the charging member in this exemplary embodiment is not particularly limited as long as the charging member includes the substrate and the outermost layer formed on the substrate. The outermost layer may be directly formed on the substrate or at least one intermediate layer such as a conductive elastic layer may be formed between the substrate and the outermost layer.

An embodiment, which is an example of the present invention, will now be described with reference to the drawings.

(Charging Member)

Figure 1:
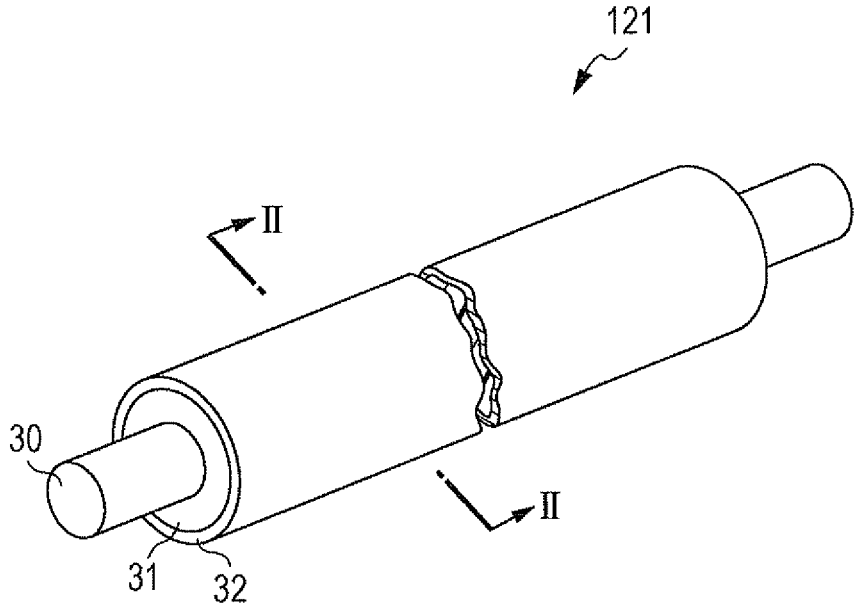
FIG. 1 is a schematic perspective view showing a charging member according to this exemplary embodiment.
Figure 2:
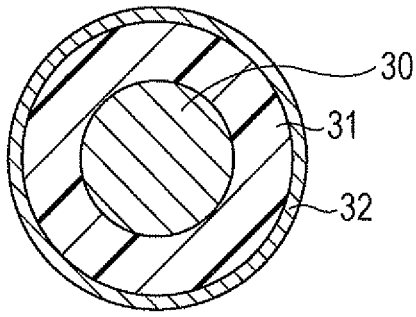
FIG. 2 is a schematic sectional view of the charging member according to this exemplary embodiment.

FIG. 1 is a schematic perspective view showing a charging member according to this exemplary embodiment. FIG. 2 is a schematic sectional view of the charging member according to this exemplary embodiment. Herein, FIG. 2 is a sectional view taken along line II-II of FIG. 1.

As shown in FIGS. 1 and 2, a charging member 121 according to this exemplary embodiment is a roll member that includes, for example, a shaft (core body) 30, a conductive elastic layer 31 formed on the peripheral surface of the shaft 30, and an outermost layer 32 formed on the peripheral surface of the conductive elastic layer 31.

A configuration of a roll member is exemplified herein, but the shape of the charging member is not particularly limited. Examples of the shape include a roll shape, a brush shape, a belt (tube) shape, and a blade shape. Among them, a roll-shaped member described in this exemplary embodiment is desired, that is, a so-called charging roll is desired.

In this specification, "conductive" means that the volume resistivity at 20° C. is less than $1\times10$ Ωcm. In this specification, "semiconductive" means that the volume resistivity at 20° C. is $1\times10$ Ωcm or more and $1\times10^{10}$ Ωcm or less.

The charging member 121 according to this exemplary embodiment is not limited to the above-described configuration. For example, the conductive elastic layer 31 is not necessarily formed. Furthermore, there may be formed an intermediate layer formed between the conductive elastic layer 31 and the shaft 30, a resistance-adjusting layer or a migration-preventing layer formed between the conductive elastic layer 31 and the outermost layer 32, or a coating layer (overcoat layer) formed on the outside of the outermost layer 32 (outermost surface). The charging member 121 according to this exemplary embodiment may be constituted by the shaft 30 and the outermost layer 32.

The substrate in this exemplary embodiment functions as an electrode and a supporting member of a charging roll. For example, the substrate is composed of a metal or alloy such as aluminum, copper alloy, or stainless steel; iron (e.g., free-cutting steel) plated with chromium, nickel, or the like; or a conductive material such as a conductive resin. In this exemplary embodiment, the shaft 30 is a conductive rod-like member and may be a member (e.g., a resin or ceramic member) whose peripheral surface is plated or a member (e.g., a resin or ceramic member) in which a conductive agent is dispersed. The shaft 30 may also be a hollow member (tube-shaped member) or a non-hollow member.

The conductive elastic layer 31 contains, for example, an elastic material and a conductive agent and optionally other additives. The conductive elastic layer 31 is an optional layer directly formed on the peripheral surface of the shaft 30.

Examples of the elastic material include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethyleneoxide copolymer rubber, epichlorohydrin-ethyleneoxide-allyl glycidyl ether copolymer rubber, ethylene-propylene-diene ternary copolymer rubber (EPDM), acrylonitrile-butadiene copolymer rubber (NBR), natural rubber, and the blend rubber of the foregoing. Among them, polyurethane, silicone rubber, EPDM, epichlorohydrin-ethyleneoxide copolymer rubber, epichlorohydrin-ethyleneoxide-allyl glycidyl ether copolymer rubber, NBR, and the blend rubber of the foregoing are desirably used. These elastic materials may be foamed or non-foamed.

Examples of the conductive agent include electronic conductive agents and ionic conductive agents. Examples of the electronic conductive agents include fine particles of carbon black such as Ketjenblack and acetylene black; pyrocarbon and graphite; various conductive metals and alloys such as aluminum, copper, nickel, and stainless steel; various conductive metal oxides such as tin oxide, indium oxide, titanium oxide, tin oxide-antimony oxide solid solution, and tin oxide-indium oxide solid solution; and insulating materials having surfaces treated to exhibit conductivity. Herein, the "electronic conductive agent" contains "conductive particles". In this exemplary embodiment, for example, carbon black or tin oxide is favorably used as the "conductive particles". Examples of the ionic conductive agents include perchloric acid salts and chlorates such as tetraethylammonium and lauryltrimethylammonium; and perchloric acid salts and chlorates of alkali metals or alkaline earth metals such as lithium or magnesium.

These conductive agents may be used alone or in combination of two or more.

Examples of carbon black include Special Black 350, Special Black 100, Special Black 250, Special Black 5, Special Black 4, Special Black 4A, Special Black 550, Special Black 6, Color Black FW200, Color Black FW2, and Color Black FW2V produced by Degussa, and MONARCH 1000, MONARCH 1300, MONARCH 1400, MOGUL-L, and REGAL 400R produced by Cabot Corporation.

The particle size of the conductive agents is preferably 1 nm or more and 200 nm or less. Note that an average particle size is measured by the following method.

A conductive agent is observed with an electron microscope to measure the diameters of 100 particles of the conductive agent. The average of the diameters is defined as an average particle size. In this specification, an average particle size measured by this method is used.

A particle size may be measured with, for example, Zetasizer Nano ZS available from SYSMEX CORPORATION.

The amount of the conductive agent added is not particularly limited. In the case of the electronic conductive agent, the amount is preferably 1 part or more and 30 parts or less by mass and more preferably 15 parts or more and 25 parts or less by mass relative to 100 parts by mass of the elastic material. In the case of the ionic conductive agent, the amount is preferably 0.1 parts or more and 5.0 parts or less by mass and more preferably 0.5 parts or more and 3.0 parts or less by mass relative to 100 parts by mass of the elastic material.

Examples of other additives added to the conductive elastic layer 31 include materials normally added to an elastic layer, such as a softener, a plasticizer, a curing agent, a vulcanizing agent, a vulcanization accelerator, an antioxidant, a surfactant, a coupling agent, and a filler (e.g., silica or calcium carbonate).

When the conductive elastic layer 31 is formed, the method and order of adding the conductive agent, the elastic material, and other components (components such as a vulcanizing agent and an optionally added foaming agent) are not particularly limited. Normally, all the components are mixed using a tumbler, a V blender, or the like in advance, and the mixture is melt-blended and extruded using an extruder.

The thickness of the conductive elastic layer 31 is preferably about 1 mm or more and 10 mm or less and more preferably about 2 mm or more and 5 mm or less. The volume resistivity of the elastic layer is preferably $10^3$ Ωcm or more and $10^{14}$ Ωcm or less.

(Outermost Layer)

The outermost layer 32 in this exemplary embodiment (the charging member of this exemplary embodiment) is an outermost layer that is in contact with a member to be charged and contains a cross-linking fluorocarbon siloxane rubber composition.

[Fluorocarbon Siloxane Rubber Composition]

A fluorocarbon siloxane rubber composition contains (A) a fluorocarbon polymer having an aliphatic unsaturated group and mainly composed of fluorocarbon siloxane represented by the structural formula (1), (3), or (4) below, (B) organopolysiloxane and/or fluorocarbon siloxane having two or more silyl groups per molecule, the molar amount of the silyl groups being 1 to 4 times the molar amount of the aliphatic unsaturated group in the fluorocarbon polymer, (C) a filler, and (D) a catalyst. The outermost layer may be formed by curing the fluorocarbon siloxane rubber composition.

First, the component (A) will be described. An example of the component (A) is a material (a material showing the structure other than the aliphatic unsaturated group) represented by the structural formula (1) below. Note that the "component (A)" is also referred to as a "main chain".

(1)

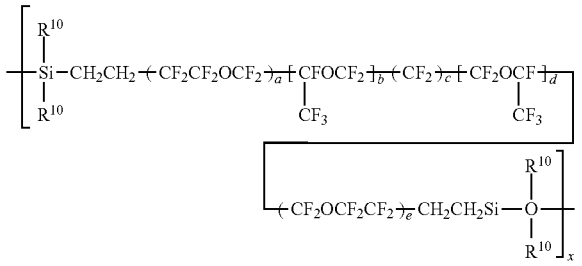

In the structural formula (1), $R^{10}$ represents an unsubstituted or substituted monovalent hydrocarbon group, a and e each independently represent 0 or 1, b and d each independently represent an integer of 1 to 4, c represents an integer of 0 to 8, and x represents an integer of 1 or more.

The unsubstituted or substituted monovalent hydrocarbon group represented by $R^{10}$ is preferably a monovalent hydrocarbon group with 1 to 8 carbon atoms, more preferably an alkyl group with 1 to 8 carbon atoms or an alkenyl group with 2 to 3 carbon atoms, and particularly preferably a methyl group. Herein, x is preferably 10 to 30. Although not shown in the structural formula (1), an aliphatic unsaturated group is provided to the terminals. A favorable example of the material represented by the structural formula (1) is a material represented by the structural formula (2) below.

(2)

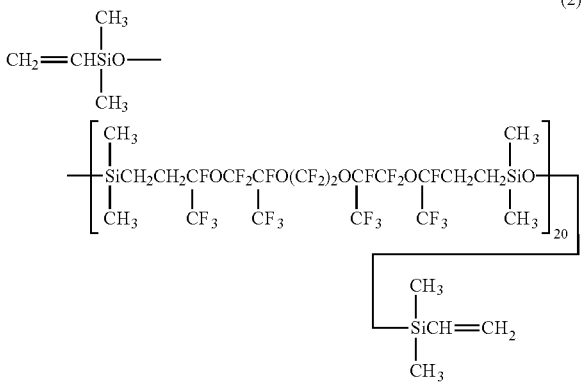

The aliphatic unsaturated group contained in the component (A) includes at least a monovalent aliphatic unsaturated hydrocarbon group. The number of carbon atoms of the monovalent aliphatic unsaturated hydrocarbon group is preferably 2 to 3. Specific examples of the monovalent aliphatic unsaturated hydrocarbon group include alkenyl groups with 2 to 3 carbon atoms such as a vinyl group, an allyl group, and an ethynyl group. In particular, a vinyl group is suitable.

The aliphatic unsaturated group is preferably present at the terminal of a molecular chain and preferably has a vinyldialkylsilyl group, a divinylalkylsilyl group, a trivinylsilyl group, or the like as a main chain. In this case, the alkyl group in the main chain of the aliphatic unsaturated group is preferably an alkyl group with 1 to 8 carbon atoms and more preferably a methyl group.

Materials represented by the structural formulas (3) and (4) are also suitably used as the component (A).

$$CH_2{=}CH{-}(X)p\text{-}Rf'{-}(X')p\text{-}CH{=}CH_2 \quad (3)$$

$$CH_2{=}CH{-}(X)p\text{-}Q\text{-}Rf'\text{-}Q\text{-}(X')p\text{-}CH{=}CH_2 \quad (4)$$

In the structural formulas (3) and (4), X is —$CH_2$—, —$CH_2O$—, —$CH_2OCH_2$—, or —Y—NR—CO— (Y is —$CH_2$— or a group represented by the structural formula (5A) below and R is a hydrogen atom, a methyl group, a phenyl group, or an allyl group), and X' is —$CH_2$—, —$OCH_2$—, —$CH_2$ $OCH_2$—, or —CO—NR'—Y'—(Y' is —$CH_2$— or a group represented by the structural formula (5B) below and R' is a hydrogen atom, a methyl group, a phenyl group, or an allyl group).

Rf' has a divalent perfluoropolyether structure and is preferably represented by $(-C_dF_{2d}O-)_q$ (d is an integer of 1 to 6 and q is an integer of 1 to 500). Herein, p is independently 0 or 1, Q is a divalent hydrocarbon group with 1 to 15 carbon atoms that may have an ether linkage. Specifically, Q is an alkylene group or an alkylene group that may have an ether linkage.

(5A)

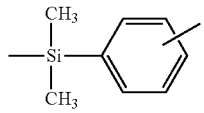

(ortho, meta, and para positions)

(5B)

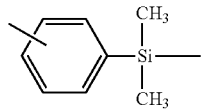

(ortho, meta, and para positions)

In particular, a material represented by the structural formula (6) below is suitable as a linear fluoropolyether compound represented by the structural formula (3) or (4).

(6)

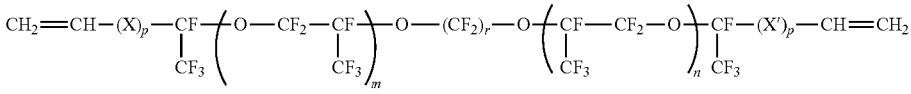

In the structural formula (6), X is —$CH_2$—, —$CH_2O$—, —$CH_2OCH_2$—, or —Y—NR—CO— (Y is —$CH_2$— or a group represented by the structural formula (5A) above and R is a hydrogen atom, a methyl group, a phenyl group, or an allyl group), and X' is —$CH_2$—, —$OCH_2$—, —$CH_2$ $OCH_2$—, or —CO—NR'—Y'— (Y' is —$CH_2$— or a group represented by the structural formula (5B) above and R' is a hydrogen atom, a methyl group, a phenyl group, or an allyl group). Furthermore, p is independently 0 or 1, r is an integer of 2 to 6, and m and n are each an integer of 0 to 200.

The weight-average molecular weight of the linear fluoropolyether compound represented by the structural formulas (3) and (4) is preferably 1,000 to 100,000 and particularly preferably 3,000 to 50,000.

The weight-average molecular weight is measured under the following conditions. In gel permeation chromatography (GPC), there are employed "HLC-8120GPC, SC-8020 (available from TOSOH CORPORATION)" as equipment, two of "TSK gel, Super HM-H (available from TOSOH CORPORATION, 6.0 mmID×15 cm)" as columns, and tetrahydrofuran (THF) as an eluate. The experiment is performed using an infrared (IR) detector at a sample concentration of 0.5%, a flow rate of 0.6 mL/min, a sample injection volume of 101, and a measurement temperature of 40° C. A calibration curve is prepared from ten samples of "polystyrene standard samples, TSK standard", namely A-500, F-1, F-10, F-80, F-380, A-2500, F-4, F-40, F-128, and F-700.

Specific examples of the linear fluoropolyether compound represented by the structural formula (6) include compounds (6A) to (6G) below. In the compounds (6A) to (6G) below, m and n are the same as those shown in the structural formula (6).

(6A)
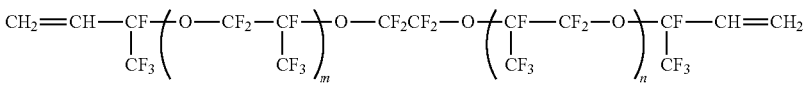
(6B)
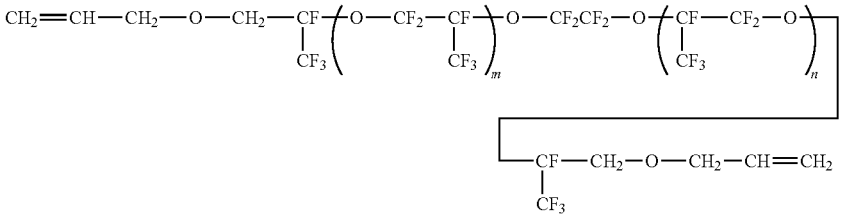
(6C)
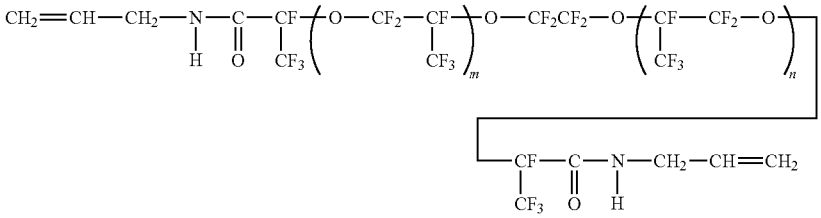
(6D)
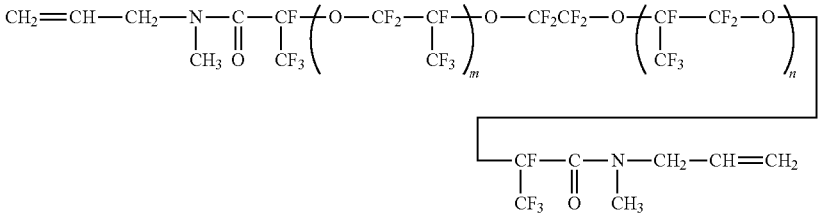
(6E)
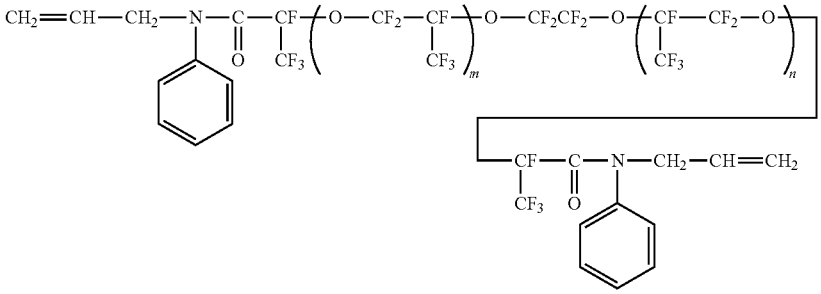
(6F)
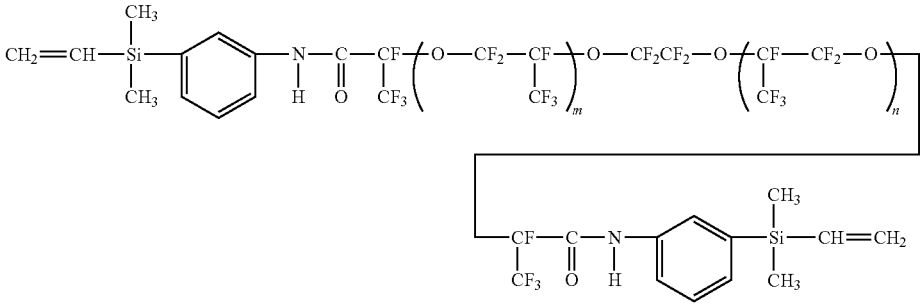

-continued (6G)

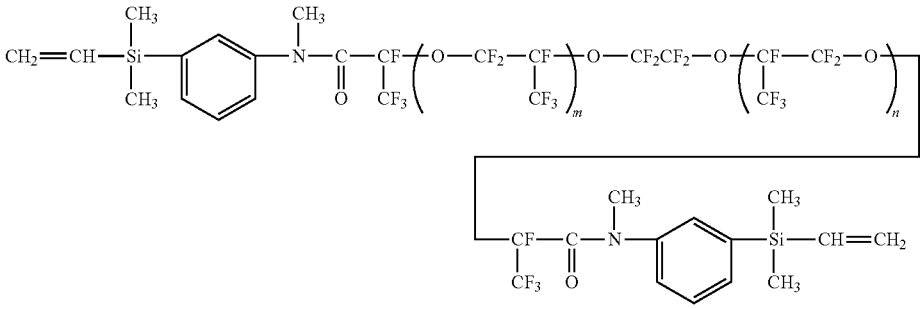

The component (B) is organopolysiloxane and/or fluorocarbon siloxane having two or more silyl groups per molecule, the molar amount of the silyl groups being 1 to 4 times the molar amount of the aliphatic unsaturated group in the fluorocarbon polymer.

Each of the silyl groups may further have a substituted group. The substituted group of the silyl group is preferably an alkyl group and more preferably a methyl group. An example of the organopolysiloxane having silyl groups is organohydrogenpolysiloxane having at least two hydrogen atoms in a molecule, the hydrogen atoms being bonded to a silicon atom.

In the fluorocarbon siloxane rubber composition used in the exemplary embodiment of the invention, the fluorocarbon polymer, which is the component (A), has an aliphatic unsaturated group and the above-described organohydrogenpolysiloxane is used as a curing agent.

That is, in this case, a cured material is produced through an addition reaction generated between the aliphatic unsaturated group in the fluorocarbon polymer and the hydrogen atoms bonded to the silicon atom in the organohydrogenpolysiloxane. Examples of such an organohydrogenpolysiloxane include various organohydrogenpolysiloxanes used for an addition-cure silicone-based rubber composition. In an exemplary embodiment of the invention, organohydrogenpolysiloxanes represented by the structural formulas (7) to (9) below are particularly suitably used.

(7)

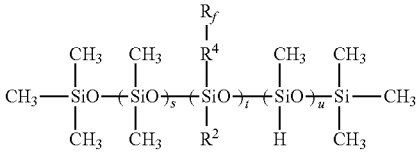

(8)

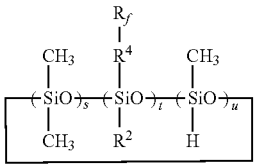

(9)

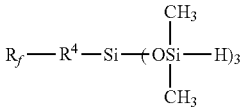

In the structural formulas (7) and (8), s and t each represent an integer of 0 or more and u represents an integer of 2 or more. $R^2$ represents an unsubstituted or substituted monovalent hydrocarbon group having no aliphatic unsaturated linkage. In the structural formulas (7) to (9), $R_f$ represents a fluorine-containing organic group and $R^4$ represents a divalent group that lies between the silicon atom and the fluorine-containing organic group $R_f$.

The number of carbon atoms of $R^2$ is preferably 1 to 12 and more preferably 1 to 8. Examples of $R^2$ include alkyl groups such as a methyl group, an ethyl group, an isopropyl group, and a butyl group; cycloalkyl groups such as a cyclohexyl group and a cyclopentyl group; aryl groups such as a phenyl group, a tolyl group, and a xylyl group; aralkyl groups such as a benzyl group and a phenylethyl group; halogenated hydrocarbon groups such as a chloromethyl group, a chloropropyl group, a chlorocyclohexyl group, a 3,3,3-trifluoropropyl group; and cyanohydrocarbon groups such as a 2-cyanoethyl group. Among them, a methyl group, an ethyl group, a phenyl group, and a 3,3,3-trifluoropropyl group are preferable.

$R^4$ is a divalent group that lies between the silicon atom and the fluorine-containing organic group $R_f$. An example of $R^4$ is a divalent hydrocarbon group having no aliphatic unsaturated linkage or a divalent hydrocarbon group having an ether group represented by general formula —R5-O—R6- (R5 and R6 are each a divalent hydrocarbon group having no aliphatic unsaturated linkage). $R^4$ preferably has 1 to 8 carbon atoms and is specifically exemplified as follows.

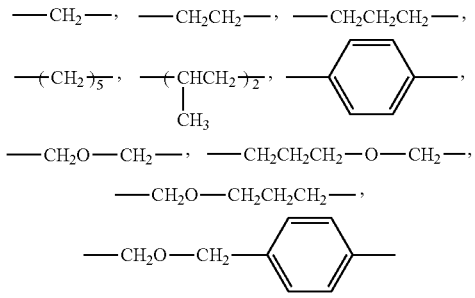

In particular, favorable examples of $R^4$ include —$CH_2$ $CH_2$—, —$CH_2$ $CH_2$ $CH_2$—, and —$CH_2$ $CH_2$ $CH_2$—O—$CH_2$—.

Examples of $R_f$ include a perfluoroalkyl group and a perfluoroalkyl ether group. The perfluoroalkyl group is represented by formula $C_pF_{2p+1}$ (p is an integer of 4 to 10) and, in particular, $C_6F_{13}$—, $C_8F_{17}$—, and $C_{10}F_{21}$— are preferable. The perfluoroalkyl ether group preferably has 5 to 15 carbon atoms, and is specifically exemplified as follows.

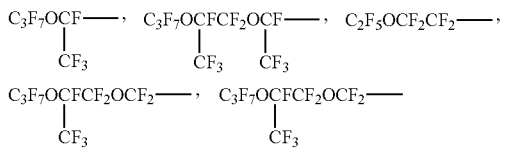

A copolymer composed of $(CH_3)_2HSiO_{0.5}$ units and $SiO_2$ units is also suitably used as the organohydrogenpolysiloxane utilized in an exemplary embodiment of the invention. The following compound is more preferable as the copolymer.

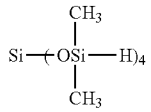

Normally, the viscosity of these organohydrogenpolysiloxanes at 25° C. is preferably 1,000 cSt or less. The organohydrogenpolysiloxane is suitably added so that the number of silyl groups is at least one and particularly one to five relative to one aliphatic unsaturated hydrocarbon group in the fluorocarbon polymer of the component (A).

Various fillers used for a typical silicone-based rubber composition are utilized as the component (C). Examples of the fillers include reinforcing fillers such as fumed silica, precipitated silica, carbon powder, titanium dioxide, aluminum oxide, quartz powder, talc, sericite, and bentonite; and fibrous fillers such as asbestos, glass fiber, and organic fiber.

These fillers are preferably added in an amount of 0.1 parts or more and 300 parts or less and particularly 1 part or more and 200 parts or less relative to 100 parts of the component (A) on a mass basis (hereinafter, the same applies). If the amount of the filler added is less than 0.1 parts, sufficient reinforcement effects are sometimes not achieved. If the amount is more than 300 parts, the mechanical strength of the cured material may be decreased.

Examples of the catalyst used as the component (D) include group VIII elements on the periodic table and the compounds thereof such as chloroplatinic acid that is a catalyst publicly known as a catalyst for addition reactions; alcohol-modified chloroplatinic acid; a complex of chloroplatinic acid and olefin; a material obtained by supporting platinum or palladium on a carrier such as alumina, silica, or carbon; a complex of rhodium and olefin; chlorotris-(triphenylphosphine) rhodium (Wilkinson's catalyst); and rhodium (III) acetylacetonate. These complexes are suitably used by being dissolved in a solvent such as an alcohol, an ether, or a hydrocarbon.

The amount of these platinum group metal catalysts added may be within the effective amount of the catalysts. Normally, the catalyst is preferably used in an amount of 1 ppm or more and 500 ppm or less and particularly 5 ppm or more and 20 ppm or less relative to 100 parts of the component (A) on a platinum group metal basis.

Various compounding agents are added to the fluorocarbon siloxane rubber composition used in this exemplary embodiment on condition that the solvent resistance is not deteriorated. For example, a dispersant such as diphenylsilanediol, hexamethyldisilazane, or dimethylpolysiloxane with low polymerization degree whose hydroxyl group at the terminal of its molecular chain is blocked; a heat resistance improving agent such as ferrous oxide, ferric oxide, cerium oxide, or iron octanoate; and a coloring agent such as a pigment are optionally added.

The hardness of the material that forms the outermost layer is adjusted by controlling a usual filler or the cross-linked and vulcanized state.

In the charging member 121 according to this exemplary embodiment, the ten-point mean roughness Rz of the surface of the outermost layer 32 needs to be 2 μm or more and 20 μm or less, and is preferably 3 μm or more and 12 μm or less, more preferably 5 μm or more and 12 μm or less, and particularly preferably 7 μm or more and 12 μm or less. Within this range, uniform chargeability is obtained and foreign substances such as toner and an external additive become not easily attached to the outermost layer 32, which produces a secondary effect of improving the deterioration resistance. If the ten-point mean roughness Rz is less than 2 μm, foreign substances such as toner and an external additive may be attached to the outermost layer 32. If the ten-point mean roughness Rz is more than 20 μm, toner, paper dust, and the like are easily accumulated on an uneven portion. At the same time, irregular electrical discharge is easily generated locally and thus image defects such as white streaks may be caused.

The ten-point mean roughness Rz is a surface roughness provided in accordance with JIS B0601 (1994). A ten-point mean roughness Rz is measured using a surface roughness meter or the like. In the exemplary embodiment of the invention, a contact-type surface roughness meter (SURFCOM 570A available from TOKYO SEIMITSU Co., Ltd.) is used in an environment of 23° C. and 55% RH. In the measurement of a surface roughness, the measurement distance is set to be 2.5 mm and a contact probe (5 μmR, 90° cone) whose edge is made of diamond is used. The average obtained by repeatedly performing the measurement three times at different places is defined as the ten-point mean roughness Rz.

The same conductive agent as that added to the conductive elastic layer 31 is described as a conductive agent added to the outermost layer 32.

Examples of other additives include materials normally added to the outermost layer, such as a conductive agent, a softener, a plasticizer, a curing agent, a vulcanizing agent, a vulcanization accelerator, an antioxidant, a surfactant, and a coupling agent.

The outermost layer may be formed on the substrate by dip coating, spray coating, or the like. In terms of ease of the production process, dip coating is suitable.

The drying conditions of a coating solution layer formed for the outermost layer are determined in accordance with the types and amounts of resin and catalyst used. The drying temperature is preferably 40° C. or higher and 200° C. or lower and more preferably 50° C. or higher and 180° C. or lower. The drying time is preferably 5 minutes or longer and 5 hours or shorter and more preferably 10 minutes or longer and 3 hours or shorter.

An example of the drying method is hot-air drying.

A gel fraction according to this exemplary embodiment is measured in accordance with JIS K6796.

Specifically, a coating solution composition for forming an outermost layer obtained by dissolving a material of the outermost layer in a solvent is applied to an aluminum plate with a bar coater to form a layer having a thickness of 100 μm. After sufficiently dried, the layer is heated and cured at a curing temperature for a curing time, the temperature and time being determined in accordance with the types of resin and catalyst contained in the coating solution. After the layer is cooled to room temperature (25° C.), the mass of the outermost layer prepared is measured and defined as the mass of a material before solvent extraction.

Subsequently, the outermost layer is dipped into the solvent used for preparing the coating solution for 24 hours. The filtration is then performed on the solvent and the remaining outermost layer resin film is sufficiently filtered. The mass of the resin film is measured and defined as the mass after extraction.

The degree of cross-linking is calculated using the formula below.

Formula: Gel fraction=100×(Mass after extraction)/(Mass before solvent extraction)

When the degree of cross-linking calculated is 50% or more or about 50% or more, the cross-linking density of a polymer in the outermost layer is improved. Such an outermost layer is judged to be a layer having good crack resistance. Only an outermost layer portion may be cut from the charging member as a measurement sample.

The outermost layer 32 is favorably thicker in consideration of wear durability of the charging member. However, if the thickness is excessively increased, the ability to charge a latent image-supporting member tends to be deteriorated. Thus, the thickness needs to be within a range of 0.01 μm or more and 1000 m or less and is preferably 3 μm or more and 25 μm or less. The volume resistivity of the outermost layer is preferably $10^3$ Ωcm or more and $10^{14}$ Ωcm or less.

By the above-described method, the charging member according to this exemplary embodiment including the outermost layer formed on the substrate is obtained.

The charging member 121 according to this exemplary embodiment is produced by sequentially forming the elastic layer 31 and the outermost layer 32 on the peripheral surface of the shaft 30 using, for example, blade coating, wire bar coating, spray coating, dip coating, bead coating, air knife coating, or curtain coating.

(Charging Device)

Figure 3:
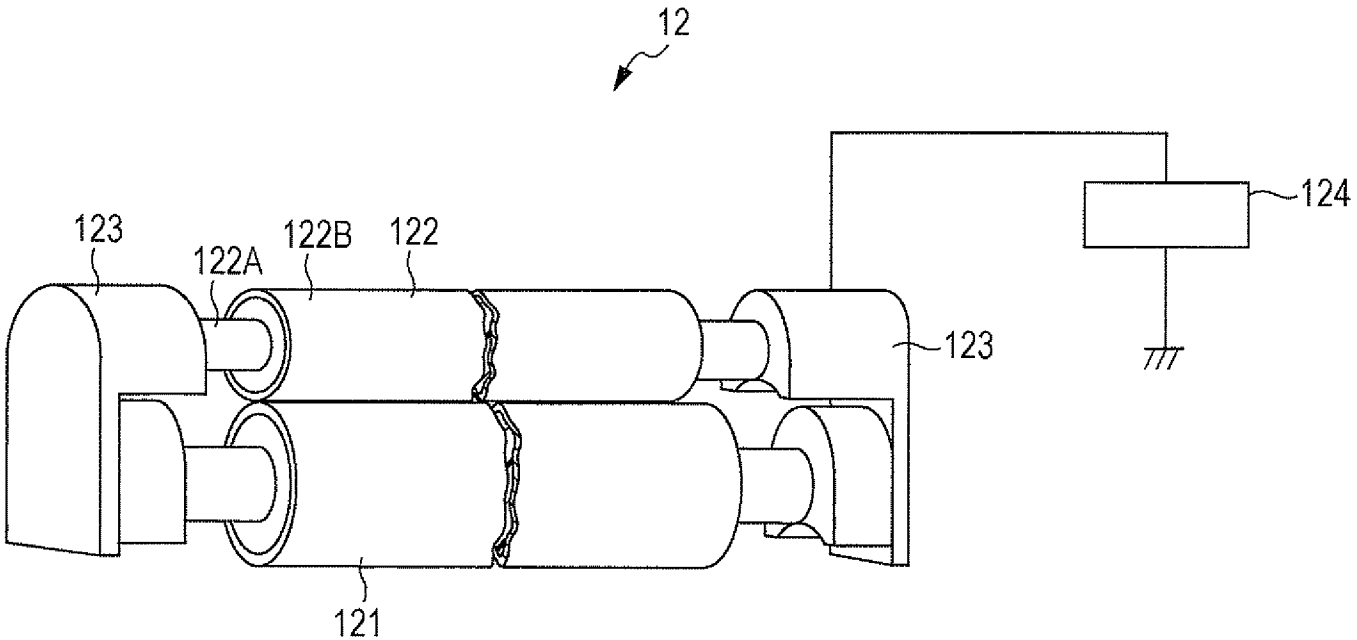
FIG. 3 is a schematic perspective view of a charging device according to this exemplary embodiment.

A charging device according to this exemplary embodiment will now be described. FIG. 3 is a schematic perspective view of the charging device according to this exemplary embodiment. In the charging device according to this exemplary embodiment, the above-described charging member according to this exemplary embodiment is employed as a charging member.

As shown in FIG. 3, for example, a charging device 12 according to this exemplary embodiment includes the charging member 121 and a cleaning member 122 arranged so as to be pressed against each other to a certain extent. Both ends of the shaft 30 of the charging member 121 and a shaft 122A of the cleaning member 122 in the axial direction thereof are supported by conductive bearings 123 so that each of the members is rotatably disposed. A power supply 124 is connected to one of the conductive bearings 123. The charging device according to this exemplary embodiment is not limited to the above-described configuration, and, for example, the cleaning member 122 is not necessarily included.

The cleaning member 122 is a member for cleaning the surface of the charging member 121 and has a roll shape, for example. The cleaning member 122 includes, for example, the shaft 122A and an elastic layer 122B formed on the peripheral surface of the shaft 122A.

The shaft 122A is a conductive rod-like member and is composed of a metal such as iron (e.g., free-cutting steel), copper, brass, stainless steel, aluminum, or nickel. The shaft 122A may be a member (e.g., a resin or ceramic member) whose peripheral surface is plated or a member (e.g., a resin or ceramic member) in which a conductive agent is dispersed. The shaft 122A may also be a hollow member (tube-shaped member) or a non-hollow member.

Favorably, the elastic layer 122B is a porous foamed body having a three-dimensional structure, has bubbles and uneven portions (hereinafter referred to as "cells") therein and thereon, and has elasticity. The elastic layer 122B contains a foaming resin material such as polyurethane, polyethylene, polyamide, polyolefin, melamine resin, or polypropylene or a foaming rubber material such as acrylonitrile-butadiene copolymer rubber (NBR), ethylene-propylene-diene copolymer rubber (EPDM), natural rubber, styrene-butadiene rubber, chloroprene rubber, silicone rubber, or nitrile rubber.

Among these foaming resin or rubber materials, polyurethane naturally having high tear strength and tensile strength is particularly suitable for efficiently cleaning foreign substances such as toner and an external additive through the friction of the charging member 121 against the cleaning member 122 driven by the charging member 121, for suppressing the formation of scratches, caused by the cleaning member 122 being rubbed against the charging member 121, on the surface of the charging member 121, and preventing occurrence of tears and damage over a long time.

The polyurethane is not particularly limited, and an example of the polyurethane is a reaction product between a polyol (e.g., polyester polyol, polyether polyester, and acrylic polyol) and an isocyanate (e.g., 2,4-tolylenediisocyanate, 2,6-tolylenediisocyanate, 4,4-diphenylmethanediisocyanate, tolidine diisocyanate, and 1,6-hexamethylenediisocyanate). The polyurethane may be a reaction product therebetween obtained by using a chain extender (e.g., 1,4-butanediol and trimethylolpropane). Polyurethane is normally foamed using a foaming agent (water or an azo compound such as azodicarbonamide or azobisisobutyronitrile).

The number of cells contained in the elastic layer 122B with a length of 25 mm is preferably 20/25 mm or more and 80/25 mm or less, more preferably 30/25 mm or more and 80/25 mm or less, and particularly preferably 30/25 mm or more and 50/25 mm or less.

The hardness of the elastic layer 122B is preferably 100 N or more and 500 N or less, more preferably 100 N or more and 400 N or less, and particularly preferably 150 N or more and 400 N or less.

The conductive bearings 123 are members that rotatably support the charging member 121 and the cleaning member 122 in an integrated manner and at the same time maintain the distance between the shafts of the members. The conductive bearings 123 may be composed of any material and have any shape as long as the conductive bearings 123 are composed of a conductive material. For example, a typical conductive bearing or a conductive sliding bearing is employed.

The power supply 124 is a device that impresses a voltage to the conductive bearings 123 and the charging member 121 and the cleaning member 122 are charged with the same polarity through the conductive bearings 123. A usual high voltage power supply is used as the power supply 124.

In the charging device 12 according to this exemplary embodiment, the charging member 121 and the cleaning member 122 are charged with the same polarity by applying voltage to the conductive bearings 123 from the power supply 124. This suppresses the accumulation, on the surfaces of the cleaning member 122 and the charging member 121, of foreign substances (e.g., toner and an external additive) that are present on the surface of an image carrier, and thus the foreign substances are transferred to the image carrier and collected by a cleaning device of the image carrier. Therefore, the accumulation of contaminants on the charging member 121 and the cleaning member 122 is suppressed and the charging properties are maintained over a long time.

(Image Forming Apparatus and Process Cartridge)

An image forming apparatus according to this exemplary embodiment includes an image carrier, a charging unit that charges the image carrier, a latent image forming unit that forms a latent image on a surface of the charged image carrier, a developing unit that forms a toner image by developing, with a toner, the latent image formed on the surface of the image carrier, and a transfer unit that transfers the toner image formed on the surface of the image carrier onto a recording medium. The above-described charging device according to this exemplary embodiment is employed as the charging unit.

A process cartridge according to this exemplary embodiment is, for example, detachably mountable to the image forming apparatus having the above configuration and includes an image carrier and a charging unit that charges the image carrier. The above-described charging device according to this exemplary embodiment is employed as the charging unit. The process cartridge according to this exemplary embodiment may optionally include at least one unit selected from the group of a developing unit that forms a toner image by developing, with a toner, a latent image formed on the surface of the image carrier, a transfer unit that transfers the toner image formed on the surface of the image carrier onto a recording medium, and a cleaning unit that removes a residual toner on the surface of the image carrier after the transfer.

Figure 4:
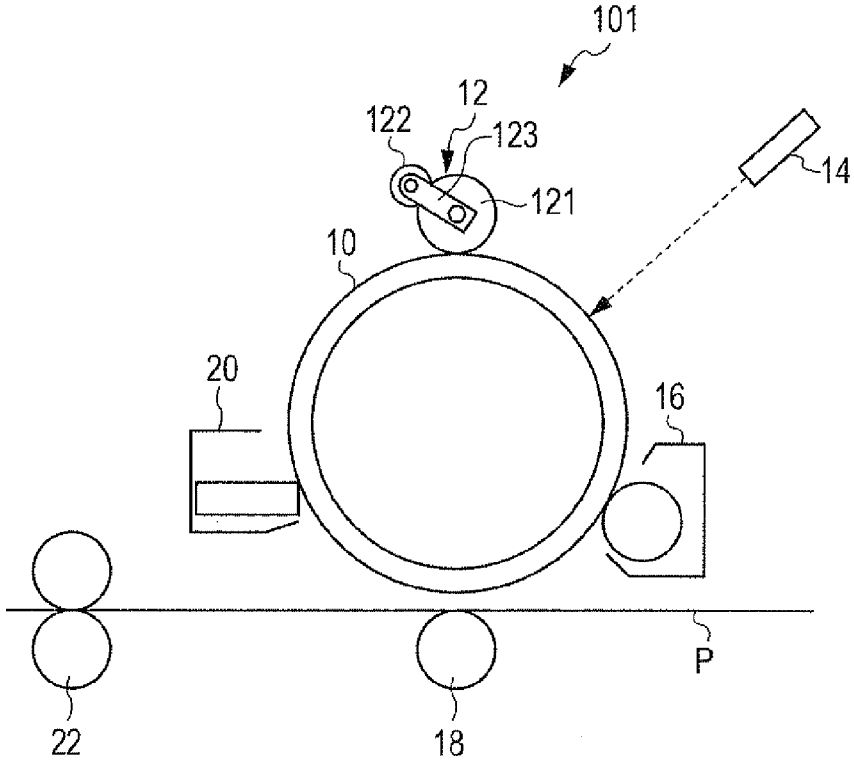
FIG. 4 schematically shows an image forming apparatus according to this exemplary embodiment.
Figure 5:
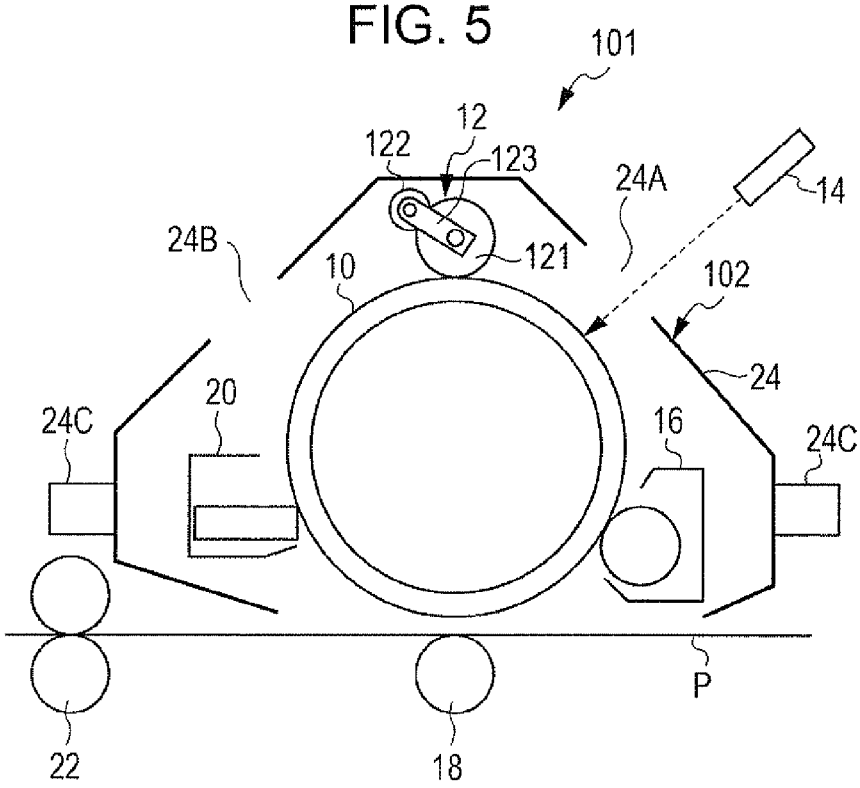
FIG. 5 schematically shows a process cartridge according to this exemplary embodiment.

The image forming apparatus and process cartridge according to this exemplary embodiment will now be described with reference to the drawings. FIG. 4 schematically shows the image forming apparatus according to this exemplary embodiment. FIG. 5 schematically shows the process cartridge according to this exemplary embodiment.

As shown in FIG. 4, an image forming apparatus 101 according to this exemplary embodiment includes an image carrier 10, a charging device 12 that charges the image carrier 10, an exposing device 14 that forms a latent image through the exposure of the image carrier 10 charged by the charging device 12, a developing device 16 that forms a toner image by developing, with a toner, the latent image formed by the exposing device 14, a transfer device 18 that transfers the toner image formed by the developing device 16 onto a recording medium P, and a cleaning device 20 that removes a residual toner on the surface of the image carrier after the transfer. The charging device 12, the exposing device 14, the developing device 16, the transfer device 18, and the cleaning device 20 are disposed around the image carrier 10. The image forming apparatus 101 also includes a fixing device 22 that fixes the toner image transferred onto the recording medium P by the transfer device 18.

In the image forming apparatus 101 according to this exemplary embodiment, there is employed, as the charging device 12, the above-described charging device according to this exemplary embodiment that includes the charging member 121, the cleaning member 122 disposed so as to be in contact with the charging member 121, the conductive bearings 123 that support both ends of the charging member 121 and the cleaning member 122 in the axial direction thereof so that each of the members is rotatably disposed, and the power supply 124 connected to one of the bearings 123.

Components of a usual electrophotographic image forming apparatus are employed as those of the image forming apparatus 101 of this exemplary embodiment, except for the charging device 12 (charging member 121). An example of each of the components will be described.

The image carrier 10 is not particularly limited, and a usual photoconductor is employed. There is suitably employed an organic photoconductor having a so-called function-separated structure in which a charge generation layer and a charge transport layer are separated from each other. An image carrier whose outermost layer is coated with an overcoat layer having charge transportability and a cross-linked structure is also suitably employed as the image carrier 10. There is also suitably employed a photoconductor including the overcoat layer containing a siloxane-based resin, a phenol-based resin, a melamine-based resin, a guanamine-based resin, or an acrylic resin as a cross-linking component.

For example, a laser optical system or an LED array is employed as the exposing device 14.

The developing device 16 is, for example, a developing device that forms a toner image by causing a developer carrier having a developer layer formed on the surface thereof to be in contact with or come close to the image carrier 10 to attach a toner to a latent image formed on the surface of the image carrier 10. A usual developing system that uses a two-component developer is suitably employed as the developing system of the developing device 16. Examples of the developing system that uses a two-component developer include a cascade system and a magnetic brush system.

A non-contact transfer system that uses a corotron or the like or a contact transfer system in which a conductive transfer roll is brought into contact with the image carrier with a recording medium P therebetween and a toner image is transferred onto the recording medium P may be employed for the transfer device 18.

The cleaning device 20 is a device that removes toner, paper dust, dirt, and the like attached to the surface of the image carrier 10 by bringing a cleaning blade into contact with the surface. In addition to the cleaning blade, a cleaning brush, cleaning roll, and the like may be employed as the cleaning device 20.

A heat fixing device that uses a heat roll is suitably employed as the fixing device 22. The heat fixing device includes a heater lamp inside a cylindrical cored bar; a fixing roller including a so-called release layer formed on the peripheral surface of the heater lamp, the release layer containing a heat-resistant resin coating layer or a heat-resistant rubber coating layer; and a pressure roller or a pressure belt disposed so as to be in contact with the fixing roller at a certain contact pressure, the pressure roller or the pressure belt including a heat-resistant elastic layer formed on the peripheral surface of the cylindrical cored bar or the surface of a belt-shaped substrate. The fixing process of an unfixed toner image is as follows. For example, the recording medium P onto which an unfixed toner image has been transferred is inserted between the fixing roller and the pressure roller or the pressure belt, and the unfixed toner image is fixed through the thermofusion of a binder resin, an additive, and the like contained in the toner.

The image forming apparatus 101 according to this exemplary embodiment is not limited to the above-described configuration, and may be, for example, an intermediate transfer type image forming apparatus that uses an intermediate transfer body or a so-called tandem image forming apparatus in which image forming units for forming toner images of different colors are arranged in parallel.

As shown in FIG. 5, the process cartridge according to this exemplary embodiment is a process cartridge 102 having a structure in which, in the image forming apparatus shown in FIG. 4, an image carrier 10, a charging device 12 that charges the image carrier 10, a developing device 16 that forms a toner image by developing, with a toner, the latent image formed by an exposing device 14, and a cleaning device that removes a residual toner on the surface of the image carrier 10 after the transfer are integrally supported in a housing 24 including an opening 24A for exposure, an opening 24B for erasing exposure, and mounting rails 24C. The process cartridge 102 is detachably mounted to the image forming apparatus 101 shown in FIG. 4.

EXAMPLES

The present invention will now be more specifically described based on Examples, but is not limited thereto.

Note that "part" means "part by mass" unless otherwise specified.

<Preparation of Photoconductor 1>

First, there is prepared a cylindrical aluminum substrate having an outer diameter of ϕ84 mm and subjected to horning treatment. Next, 100 parts by mass of zirconium compound (product name: Orgatics ZC540 available from Matsumoto Seiyaku KK), 10 parts by mass of silane compound (product name: A1100 available from Nippon Unicar Company Limited), 400 parts by mass of isopropanol, and 200 parts by mass of butanol are mixed to obtain a coating solution for forming an undercoat layer. The coating solution is applied on the aluminum substrate by dip coating and dried by heating at 150° C. for 10 minutes to form an undercoat layer having a thickness of 0.1 μm.

Subsequently, a mixture of 1 part by mass of hydroxygallium phthalocyanine having strong diffraction peaks at Bragg angles (2θ±0.20) of 7.5°, 9.9°, 12.5°, 16.3°, 18.6°, 25.1°, and 28.3° in the X-ray diffraction spectrum measured using a CuKα characteristic X-ray, 1 part by mass of polyvinyl butyral (S-LEC BM-S available from Sekisui Chemical Co., Ltd.), and 100 parts by mass of n-butyl acetate is dispersed together with glass beads for one hour using a paint shaker to obtain a coating solution for forming a charge generation layer. The coating solution is applied on the undercoat layer by dip coating and dried by heating at 100° C. for 10 minutes to form a charge generation layer having a thickness of about 0.15 μm.

Next, 2 parts by mass of charge transport material represented by the formula (V-3) below, 3 parts by mass of polymer compound (viscosity-average molecular weight: 50,000) having the structural unit represented by the formula (V-4) below, and 20 parts by mass of chlorobenzene are mixed to obtain a coating solution for forming a charge transport layer.

(V-3)

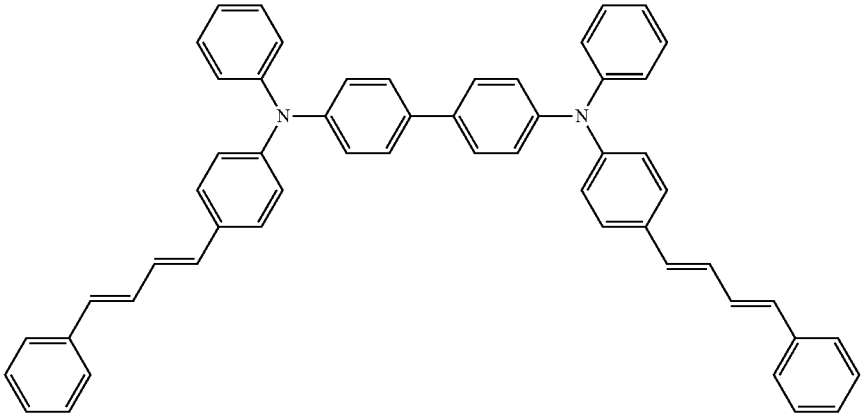

(V-4)

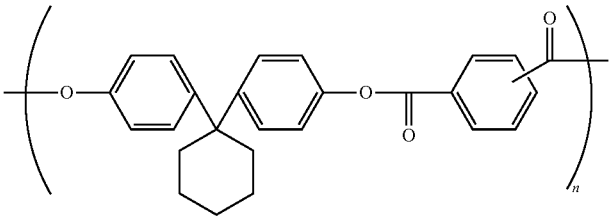

The coating solution for forming a charge transport layer is applied on the charge generation layer by dip coating and heated at 110° C. for 40 minutes to form a charge transport layer having a thickness of 20 μm. The photoconductor including the undercoat layer, the charge generation layer, and the charge transport layer formed on the aluminum substrate subjected to horning treatment is assumed to be a "photoconductor 1".

<Preparation of Photoconductor 2>

There are prepared 7 parts by mass of resole phenolic resin (PL-2211 available from Gun Ei Chemical Industry Co., Ltd.) and 0.03 parts by mass of methylphenylpolysiloxane. They are dissolved in 15 parts by mass of isopropanol and 5 parts by mass of methyl ethyl ketone to obtain a coating solution for forming an overcoat layer. The coating solution is applied on the photoconductor 1 by dip coating and dried at 130° C. for 40 minutes to form an overcoat layer having a thickness of 3 μm. The obtained photoconductor is assumed to be a "photoconductor 2".

<Preparation of Cleaning Member>

Polyurethane EP 70 available from INOAC CORPORATION is cut into a size of 20 mm×20 mm×250 mm to obtain a cleaning pad a for a charging member. Furthermore, a core made of SUS303 and having an outer diameter of ϕ5 mm and a length of 230 mm is inserted into the cleaning pad a. The core and the cleaning pad a containing a urethane foam are bonded to each other using a hot-melt adhesive. Portions of the cleaning pad a up to positions 5 mm from both ends of the core are cut off to obtain an elastic roll material. The elastic roll material is ground to obtain a cleaning roll a for a charging member having an outer diameter of ϕ9 mm.

A cleaning roll b for a charging member is obtained in the same manner as described above, except that the urethane foam used is replaced with Polyurethane RSC available from INOAC CORPORATION.

[Production of Charging Member]

<Preparation of Charging Roll>

—Formation of Conductive Elastic Layer—

A mixture of the materials shown in Table 1, the mixture having the composition shown in Table 2, is kneaded using an open roll, and then pressed on the surface of a conductive support made of SUS303 and having a diameter of 8 mm with an adhesive layer therebetween using a press molding machine to form a roll having a diameter of 15 mm. The roll is ground to obtain a charging roll A having a diameter of 14 mm and including a conductive elastic layer. Note that hereinafter, the amount added is expressed in "part by mass".

TABLE 1

| | | Type of material | Model No./Manufacturer |
|---|---|---|---|
| Conductive elastic layer | Rubber | epichlorohydrin rubber | Gechron 3106/ZEON CORPORATION |
| | | nitrile butadiene rubber | N250S/JSR |
| | Conductive agent | benzyltriethylammonium chloride | KANTO CHEMICAL CO., INC. |
| | | carbon black | Ketjenblack EC/Lion Corporation |
| | Vulcanizing agent | sulfur | SULFAX PS/TSURUMI CHEMICAL INDUSTRY CO., LTD. |
| | Vulcanization accelerator | tetramethylthiuram disulfide | NOCCELER TT/OUCHI SHINKO CHEMICAL INDUSTRIAL Co., Ltd. |
| | | dibenzothiazolyl disulfide | NOCCELER DM/OUCHI SHINKO CHEMICAL INDUSTRIAL Co., Ltd. |
| | Filler | calcium carbonate | Silver-W/Shiraishi Kogyo Kaisha, Ltd. |
| | Vulcanization accelerator | stearic acid | KANTO CHEMICAL CO., INC. |
| | | zinc oxide | zinc oxide (first class)/Seido Chemical Industry Co., Ltd. |

TABLE 2

| | | Type of material | | Amount added A |
|---|---|---|---|---|
| Conductive elastic layer | Composition | Rubber | epichlorohydrin rubber | 95.6 |
| | | | nitrile butadiene rubber | 4.4 |
| | | Conductive agent | benzyltriethylammonium chloride | 0.9 |
| | | | carbon black | 15 |
| | | Vulcanizing agent | sulfur | 0.5 |
| | | Vulcanization accelerator | tetramethylthiuram disulfide | 1.5 |
| | | | dibenzothiazolyl disulfide | 1.5 |
| | | Filler | calcium carbonate | 20 |
| | | Vulcanization accelerator | stearic acid | 1 |
| | | | zinc oxide | 5 |
| | Thickness | | | 2 mm |

<Formation of Outermost Layer>

[Component (A)]

Polymer 1

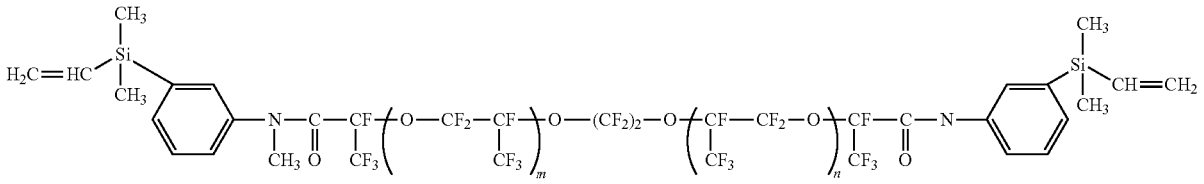

m + n = 90

-continued

Polymer 2

(2)

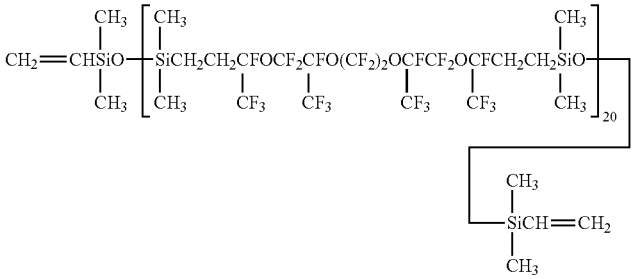

Polymer 3

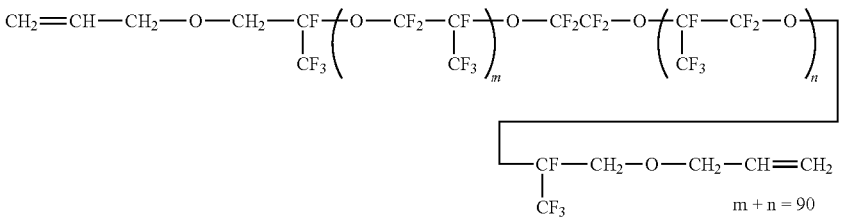

Polymer 4

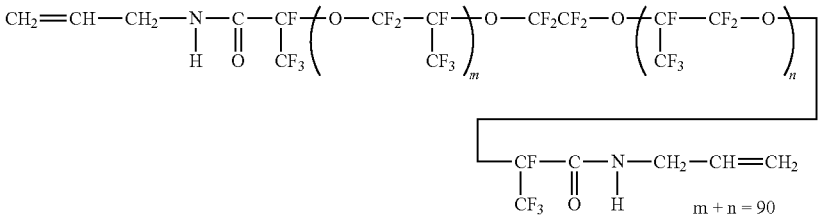

[Component (B)]

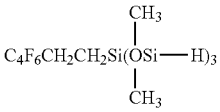

Organohydrogenpolysiloxane 1

[Component (B)]

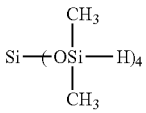

Organohydrogenpolysiloxane 2

[Component (C)]

Filler 1: AEROSIL R972 (available from Nippon Aerosil Co., Ltd.)

[Component (C)]

Filler 2: AEROSIL R974 (available from Nippon Aerosil Co., Ltd.)

—Formation of Outermost Layer—

Each of mixtures having the compositions shown in Tables 3 and 4 is diluted in benzotrifluoride so as to have a solid content of 20%. A dispersion obtained by dispersing the mixture using a bead mill is applied on the surface of the charging roll A by dip coating and dried by heating at 180° C. for 30 minutes to form an outermost layer having a thickness of 10 μm. Thus, charging members (charging rolls) of Examples, Comparative Examples, and Reference Example shown in Tables 3 and 4 are obtained. Each of the charging members is installed in an image forming apparatus including the photoconductor 1 or the photoconductor 2 to obtain an image forming apparatus.

TABLE 3

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Photoconductor | | 1 | 1 | 1 | 1 | 1 | 2 | 1 | 1 |
| Component (A) | Polymer 1 | 100 | 100 | 100 | 100 | — | — | — | — |
| | Polymer 2 | — | — | — | — | 100 | 100 | — | — |
| | Polymer 3 | — | — | — | — | — | — | 100 | — |
| | Polymer 4 | — | — | — | — | — | — | — | 100 |
| Component (B) | Organohydrogenpolysiloxane 1 | 18.8 | 18.8 | 10 | — | 18.8 | 18.8 | 18.8 | 18.8 |
| | Organohydrogenpolysiloxane 2 | — | — | 8.8 | 18.8 | — | — | — | — |

TABLE 3-continued

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Component (C) | Filler 1 | — | 5 | — | — | — | — | — | — |
| | Filler 2 | — | — | 5 | — | — | — | — | — |
| Conductive particles | Carbon black | 15 | 15 | 15 | 15 | 15 | 15 | 15 | 15 |
| Catalyst | Platinum-divinyltetramethyldisiloxane complex (platinum concentration: 0.5%) | 0.2 | 0.2 | 0.2 | 0.2 | 0.2 | 0.2 | 0.2 | 0.2 |
| Gel fraction (%) | | 92 | 99 | 90 | 93 | 94 | 89 | 97 | 91 |
| Evaluation of deterioration resistance | after printing of 25,000 sheets | A | A | A | A | A | A | A | A |
| | after printing of 50,000 sheets | B | A | A | A | B | B | B | B |
| Evaluation of image quality after storage | | B | A | A | A | B | B | B | B |
| Evaluation of bleed resistance | | B | A | A | A | B | B | B | B |
| Durability | | B | A | A | A | B | B | B | B |

Carbon black: MONARCH 1000 (available from Cabot Corporation)
Ex.: Example

TABLE 4

| | | C.E. 1 | C.E. 2 | C.E. 3 | R.E. |
|---|---|---|---|---|---|
| Photoconductor | | 1 | 1 | 1 | 1 |
| Component (A) | Polymer 1 | — | — | — | 100 |
| | Polymer 2 | — | — | — | — |
| | Polymer 3 | — | — | — | — |
| | Polymer 4 | — | — | — | — |
| Component (B) | Organohydrogenpolysiloxane 1 | — | — | — | 18.8 |
| | Organohydrogenpolysiloxane 2 | — | — | — | — |
| Component (C) | Filler 1 | — | — | — | — |
| | Filler 2 | — | — | — | — |
| Conductive particles | Carbon black | 13 | 13 | 13 | 15 |
| Catalyst | Platinum-divinyltetramethyldisiloxane complex (platinum concentration: 0.5%) | — | 0.2 | 0.2 | — |
| Commercially available composition | Fluororubber composition | 100 | — | 50 | — |
| | Silicone resin composition | — | 100 | 50 | — |
| Gel fraction (%) | | 98 | 90 | 46 | 23 |
| Evaluation of deterioration resistance | after printing of 25,000 sheets | A | C | C | D |
| | after printing of 50,000 sheets | C | D | D | D |
| Evaluation of image quality after storage | | D | B | C | D |
| Evaluation of bleed resistance | | B | D | D | D |
| Durability | | B | D | D | D |

Carbon black: MONARCH 1000 (available from Cabot Corporation)
Fluororubber composition: a solution obtained by dispersing 100 parts of polyol-crosslinkable fluororubber (G-801 available from DAIKIN INDUSTRIES, LTD.) and 5 parts of magnesium oxide (Kyowa Mag DHT-4A available from Kyowa Chemical Industry Co., Ltd.) in methyl ethyl ketone (MEK)
Silicone resin composition: KE-4895 (available from Shin-Etsu Chemical Co., Ltd.)
C.E.: Comparative Example
R.E.: Reference Example <Evaluation of Charging Member>

Regarding the charging rolls obtained in Examples and Comparative Examples, the deterioration resistance, the image quality after storage, the bleed resistance, and the durability and image quality are evaluated.

—Evaluation of Deterioration Resistance—

Each of the charging rolls of Examples and Comparative Examples produced by the above-described method is installed in a drum cartridge of DocuCentre Color 400CP (Fuji Xerox Co., Ltd.) shown in FIG. 4. A printing test is performed on 50,000 A4 sheets (after 25,000 sheets are printed in an environment of 10° C. and 15% RH, 25,000 sheets are printed in an environment of 28° C. and 85% RH) using a magenta toner for DocuCentre Color 400CP. If a serious problem occurs during the printing test, the printing is stopped at that timing.

Regarding the images before the printing test and after 50,000 sheets have been printed, the image quality is evaluated through visual inspection using the following criteria based on the presence or absence of density unevenness in a halftone image.

A: There is no defect such as density unevenness.

B: Very slight density unevenness is observed.

C: Slight density unevenness is observed.

D: Density unevenness not permitting practical use is observed.

—Evaluation of Storage—

Each of the charging rolls of Examples, Comparative Examples, and Reference Example shown in Tables 3 and 4 is installed in a drum cartridge of DocuCentre Color 400CP (Fuji Xerox Co., Ltd.). After the DocuCentre Color 400CP is left to stand for one month in an environment of 45° C. and 95% RH, a halftone image is printed out using the DocuCentre Color 400CP in a normal environment. The presence or absence of streak defects of a charging roll pitch in the halftone image is evaluated through visual inspection using the following criteria.

A: There are no streak defects.

B: Very slight streak defects are observed.

C: Slight streak defects are observed.

D: Streak defects not permitting practical use are observed.

—Uniform Chargeability (Bleed Resistance)—

Each of the charging rolls is installed in a drum cartridge of DocuCentre Color 400CP (Fuji Xerox Co., Ltd.). After the DocuCentre Color 400CP is left to stand for three days in an environment of 28° C. and 85% RH, a printing test of ten A4 sheets is performed and then a 50% halftone image is printed using the DocuCentre Color 400CP. In the obtained image, an image of a contact portion between the photoconductor and the charging member is observed through visual inspection. The presence or absence of image defects caused by bleeding derived from the elastic layer of the charging member is evaluated using the following criteria.

A: There are no image irregularities at all.

B: Very slight image irregularities are observed but cause no problem at all.

C: Slight image irregularities are observed but cause no problem.

D: Image irregularities are observed to some degree.

—Evaluation of Durability and Image Quality—

Each of the charging rolls is installed in a drum cartridge of DocuCentre Color 400CP (Fuji Xerox Co., Ltd.). After a printing test is performed on 50,000 A4 sheets (50,000 A4 sheets are printed in an environment of 10° C. and % RH), a 50% halftone image is printed using the DocuCentre Color 400CP. The obtained image is observed through visual inspection and evaluated using the following criteria.

A: There are no image irregularities at all.

B: Very slight image irregularities are observed but cause no problem at all.

C: Slight image irregularities are observed but cause no problem.

D: Image irregularities are observed to some degree.

As examples of applications of the exemplary embodiment of the invention, there are image forming apparatuses such as an electrophotographic copier and a printer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member, comprising:

a substrate; and an outermost layer that is on the substrate, is in contact with a member to be charged, and contains a cross-linking fluorocarbon siloxane rubber composition, wherein the charging member charges the member to be charged by being brought into contact with the member to be charged while a voltage is applied, and the cross-linking fluorocarbon siloxane rubber composition comprises:

(A) a fluorocarbon polymer having an aliphatic unsaturated group and mainly composed of fluorocarbon siloxane represented by the structural formula (1), (3), or (4) below;

(B) organopolysiloxane and/or fluorocarbon siloxane having two or more silyl groups per molecule, the molar amount of the silyl groups being 1 to 4 times the molar amount of the aliphatic unsaturated group in the fluorocarbon polymer;

(C) a filler; and (D) a catalyst, (1)

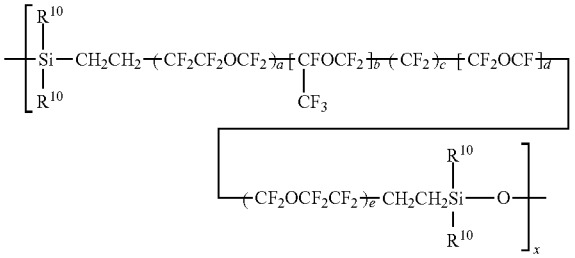

where in the structural formula (I):

$R^{10}$ represents an unsubstituted or substituted monovalent hydrocarbon group, a and e each independently represent 0 or 1, b and d each independently represent an integer of 1 to 4, c represents an integer of 0 to 8, and x represents an integer of 1 or more, $$CH_2{=}CH{-}(X)p\text{-}Rf'{-}(X')p\text{-}CH{=}CH_2 \quad (3)$$

$$CH_2{=}CH{-}(X)p\text{-}Q\text{-}Rf'\text{-}Q\text{-}(X')p\text{-}CH{=}CH_2 \quad (4)$$

where in the structural formulas (3) and (4):

X is $-CH_2-$, $-CH_2O-$, $-CH_2OCH_2-$, or $-Y-NR-CO-$, wherein Y is $-CH_2-$ or a group represented by the structural formula (5A) below and R is a hydrogen atom, a methyl group, a phenyl group, or an allyl group, (5A)

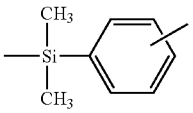

X' is $-CH_2-$, $-OCH_2-$, $-CH_2OCH_2-$, or $-CO-NR'-Y'-$, wherein Y' is $-CH_2-$ or a group represented by the structural formula (5B) below and R' is a hydrogen atom, a methyl group, a phenyl group, or an allyl group, (5B)

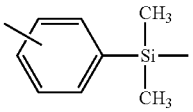

Rf' has a divalent perfluoropolyether structure, p is independently 0 or 1, and

Q is a divalent hydrocarbon group with 1 to 15 carbon atoms that may have an ether linkage.

2. The charging member according to claim 1, wherein a gel fraction of the outermost layer is about 50% or more.

3. The charging member according to claim 2, wherein an elastic layer containing a synthetic rubber is between the substrate and the outermost layer.

4. The charging member according to claim 3, wherein the elastic layer contains conductive particles.

5. The charging member according to claim 3, wherein the synthetic rubber is a member selected from the group consisting of polyurethane, silicone rubber, ethylene-propylene-diene copolymer rubber, epichlorohydrin-ethyleneoxide copolymer rubber, epichlorohydrin-ethyleneoxide-allyl glycidyl ether copolymer rubber, acrylonitrile-butadiene copolymer rubber, and a blend rubber of the foregoing.

6. The charging member according to claim 1, wherein an elastic layer containing a synthetic rubber is between the substrate and the outermost layer.

7. The charging member according to claim 6, wherein the elastic layer contains conductive particles.

8. The charging member according to claim 6, wherein the synthetic rubber is a member selected from the group consisting of polyurethane, silicone rubber, ethylene-propylene-diene copolymer rubber, epichlorohydrin-ethyleneoxide copolymer rubber, epichlorohydrin-ethyleneoxide-allyl glycidyl ether copolymer rubber, acrylonitrile-butadiene copolymer rubber, and a blend rubber of the foregoing.

9. A process cartridge comprising at least one unit selected from the group of:

an image carrier;

a charging unit that charges the image carrier;

an exposing unit that forms an electrostatic latent image on the charged image carrier by exposing the image carrier;

a developing unit that forms a toner image by developing the electrostatic latent image with a developer for developing an electrostatic charge image;

a transfer unit that transfers the toner image from the image carrier onto a transfer-receiving body; and a cleaning unit that removes a toner left on a surface of the image carrier, wherein a charging member used in the charging unit is the charging member according to claim 1.

10. The process cartridge according to claim 9, wherein a gel fraction of the outermost layer is about 50% or more.

11. The process cartridge according to claim 9, wherein an elastic layer containing a synthetic rubber is between the substrate and the outermost layer.

12. An image forming apparatus, comprising:

a latent image forming unit that contains the charging member of claim 1 and forms a latent image on a latent image carrier using the charging member;

a developing unit that develops the latent image with a developer for developing an electrostatic charge image;

a transfer unit that transfers a developed toner image onto a transfer-receiving body with or without an intermediate transfer body; and a fixing unit that fixes the toner image formed on the transfer-receiving body.

13. The image forming apparatus according to claim 12, wherein a gel fraction of the outermost layer is about 50% or more.

14. The image forming apparatus according to claim 12, wherein an elastic layer containing a synthetic rubber is between the substrate and the outermost layer.

* * * * *